US006547087B2

(12) United States Patent
Accatino

(10) Patent No.: US 6,547,087 B2
(45) Date of Patent: Apr. 15, 2003

(54) STORAGE STRUCTURE WITH HINGED PANELS

(75) Inventor: Henri Accatino, Annecy le Vieux (FR)

(73) Assignee: Feralp, societe anonyme, Dingy Saint Clair (FR)

( * ) Notice: Subject to any disclaimer, the term of this patent is extended or adjusted under 35 U.S.C. 154(b) by 0 days.

(21) Appl. No.: 09/765,201

(22) Filed: Jan. 18, 2001

(65) Prior Publication Data

US 2001/0008223 A1 Jul. 19, 2001

(30) Foreign Application Priority Data

Jan. 19, 2000 (FR) ..... 00 00870

(51) Int. Cl.[7] ..... A47F 5/10; A47F 7/16
(52) U.S. Cl. ..... 211/169; 211/48; 211/96
(58) Field of Search ..... 211/169, 168, 211/96, 48, 47; 160/135

(56) References Cited

U.S. PATENT DOCUMENTS 1,688,255 A 10/1928 Wasch ..... 211/169 X
3,017,999 A * 1/1962 Cano ..... 211/169 X
3,351,211 A * 11/1967 Best ..... 211/169
3,391,796 A * 7/1968 Cross ..... 211/169
3,777,896 A * 12/1973 Ehrlich ..... 211/169 X
3,986,758 A * 10/1976 Heaney ..... 211/187 X
5,139,155 A * 8/1992 Laxson ..... 211/169
6,216,890 B1 * 4/2001 Rathmer ..... 211/175
6,237,782 B1 * 5/2001 Hunn ..... 211/47
6,260,296 B1 * 7/2001 Carney, Jr. ..... 211/169 X

* cited by examiner

*Primary Examiner*—Daniel P. Stodola
*Assistant Examiner*—Erica B. Harris
(74) *Attorney, Agent, or Firm*—William H. Eilberg

(57) ABSTRACT

A storage structure includes generally rectangular panels arranged in at least one group of panels that are vertically oriented and each hinged about a respective hinge pin to a common connecting structure to pivot between two limit orientations. Each end panel has, on its bottom horizontal edge, a support wheel, which rolls on the floor to support the panel cantilever-fashion. Each panel can carry objects, such as works of art, that can be observed from a sufficient distance in a storeroom. Both faces of each panel are accessible and can be used to fix objects, which maximizes the available storage area.

14 Claims, 11 Drawing Sheets

STORAGE STRUCTURE WITH HINGED PANELS

BACKGROUND OF THE INVENTION

1. Field of the Invention

The present invention relates to structures for storing works of art such as paintings in the reserve collections of museums.

2. Description of the Prior Art

Museums generally have an exhibition part in which some works of art are displayed, and a reserve collection part in which a large number of works are stored between the periods in which they are exhibited.

The works of art stored in the reserve collections must remain accessible so that they can be viewed from a sufficient distance to enable museum staff to prepare future exhibitions by choosing appropriate works.

To reduce the structure cost of museum reserve collections, it is beneficial to maximize the number of works that can be stored in a reserve collection of given area, whilst guaranteeing good accessibility and a sufficient viewing distance to gauge the works in storage.

At present, works of art like paintings are stored on various structures. A first prior art solution consists of storing the works on the walls of a reserve collection room, possibly with an intermediate partition on which works are also placed. With this solution, if a room approximately five by five meters is available, the area available to receive the works is approximately 69 square meters.

A second prior art solution is described in the document EP 0 600 506 A, for the same size five by five meter reserve collection storeroom, and entails storing the works on suspended grids disposed in a row of parallel vertical grids each of which can be moved in horizontal translation in its plane, with a supporting wheel at the bottom. In this way a selected grid can be moved to examine the works that it carries. This increases the available area for receiving works.

In a third prior art solution, the grids are also disposed in a row of parallel vertical grids but, instead of being movable in their own plane, can be moved perpendicularly to their plane, on mobile carriages. Both faces of the grids can then be used to store works of art and this increases the available area to approximately 144 square meters, again in a five by five meter reserve collection storeroom.

In a different technical art, the document U.S. Pat. No. 1,688,255 A describes a display unit for screens, doors and windows. The screens, doors or windows are fixed by clamps to bottom horizontal beams and to parallel hinge pins of a structure with transverse bars fixed to a building. The structure is not auto-stable, and is not suitable for storing objects such as works of art. In particular it is not possible to hang paintings on a structure of this kind by conventional hanging means on their rear face or to guarantee their integrity.

The document EP 0 599 112 A describes a display unit for ceramic tiles, including a frame with uprights, crossmembers, and a rectangular base, and tile support panels mounted to rotate through 360° between top and bottom beams themselves pivoted to the frame. A device of this kind is complex because of the frame with its base, pivoting beams and means for hinging the panels, and is not suitable for supporting works of art because there is a high risk of impacts between a pivoting panel and objects secured to adjacent panels.

One problem addressed by the present invention is that of further increasing the area available for storing works of art in the reserve collections of museums, whilst providing access to the works and a sufficient viewing distance for examining them, without necessitating or allowing manipulations entailing the risk of damaging the works. The storage structure must be stable and self-contained, must not necessitate any fixing to a building, and must be capable of being folded into a compact folded configuration.

Another object of the invention is to design a storage structure of the above kind that is particularly reliable, simple and inexpensive, in order to reduce further the cost of installing and using the structure.

A subsidiary object of the invention is to provide better protection of works of art suspended from the storage structure. They must in particular be protected against various types of hazard, including impacts, vibrations, dust, moisture and running water.

Another subsidiary object of the present invention is to provide the facility to adjust the hinged panels to receive thinner or thicker objects without risk of contact or impact with the objects on adjacent panels. The adjustment must use simple tools such as a wrench and no modification of the components.

SUMMARY OF THE INVENTION

To achieve the above and other objects, a storage structure in accordance with the invention includes hinged generally rectangular panels adapted to receive and support objects, such as works of art, the structure being such as:

- the panels are organized into at least one first group of generally rectangular panels oriented vertically and having panels that are each hinged directly about a respective hinge pin in the vicinity of a first vertical edge to a common connecting structure to pivot approximately 90° between two limit orientations,
- respective hinge pins of consecutive hinged panels are offset laterally on the common connecting structure by a distance chosen to allow the panels to rotate between the limit orientations without objects that they carry touching each other, and
- at least some panels include, on their bottom horizontal edge, a support means at a distance from the hinge pin of the panel and adapted to bear on a floor and thereby stabilize the structure as a whole on the floor.

In a first embodiment, each hinged panel includes a rolling member constituting support means and adapted to roll on the floor in a rolling area with a smooth surface.

In one simple and effective embodiment, one of the end panels is fixed, permanently oriented in the first limit orientation at approximately 45° to the common connecting structure, and rests permanently on the floor. The other panels are hinged.

In one advantageous embodiment, suitable for smaller sizes, the intermediate hinged panels have no rolling members, and are supported only by their respective hinge pins, on which they pivot. This reduces vibrations caused by rolling on the floor, which offers better protection to the works of art. However, it is then preferable for the size of the structure to be relatively small, to limit the weight supported by each bearing point on the floor.

Additional protection against vibrations and impacts can be provided by damped actuators adapted to pivot each hinged panel smoothly and gently to either of its limit orientations from a median orientation that is generally perpendicular to the common connecting structure. The user can therefore let go of the hinged panel as soon as it has passed beyond the median orientation, whereupon the hinged panel returns to its chosen limit orientation of its own accord with a slow and damped movement.

In one particular embodiment, the end panels are advantageously solid, constituting covering walls for enclosing all of the intermediate panels when the structure is in a folded configuration. This improves the protection of the works of art against dust and other external pollutants.

In a first embodiment, the storage structure includes panels comprising one or more rigid rectangular frames each of which surrounds and retains a grid. Works can therefore be fixed to the grid, at any required location, by fixing means such as hooks or ligatures.

An advantageous variant of this embodiment replaces the grid with parallel laths retained by the uprights of the panel frame. The laths can be made of aluminum, for example, and incorporate perforations enabling the use of various systems for attaching works of art. One benefit of this is that the laths are easier to install and assemble in small places intended to contain the storage structure.

An advantageous embodiment replaces the grid with one or more perforated and corrugated plates held by the uprights and crossmembers of the panel frame. One benefit of this is that works of art can be attached to both faces of the panel without the attachment means interfering with the other face.

In another embodiment, the storage structure includes panels consisting of a rectangular frame surrounding and retaining horizontal shelves. Objects can then be placed on the shelves.

Each hinged panel is preferably mounted on the common connecting structure by means of top and bottom pivots, passing through respective top and bottom holes in the panel, with at least one of the pivots removably attached to the common connecting structure.

It may be beneficial to provide means for preventing objects stored on the panels touching each other during pivoting movements of the hinged panels. To this end, the upper or peripheral areas of the panels can advantageously include, away from the hinge pins, abutment means to guarantee a sufficient distance between consecutive panels to prevent contact between the objects they carry.

In a folded configuration, the peripheral frames of consecutive panels are preferably contiguous, possibly with combined buffers and seals between them. The frames of the panels then constitute a dustproof surround which protects the works contained within the structure. The walls of the end frames are then sealed, or at least dustproof, and permeable to air, for example being made from Gore-Tex® distributed fiber fabric.

To adjust the thickness available for the works secured to a panel, the vertical uprights of the panel frame can have parallel profiles defining successive or movable housings which can receive the perforated plates or the laths or grid constituting the central structure of the panel so that the user can choose the position of the central structure to define a thinner or thicker free space on respective opposite faces of the panel to receive objects.

The common connecting structure to which the panels are hinged can advantageously include a generally rectangular frame with two uprights connected by two crossmembers with the crossmembers receiving the hinge means of the panels and the common connecting structure resting on the floor on height adjusting means such as two screw-jacks. This assures the smoothest possible movement of the hinged panels and makes the structure more stable.

Other objects, features and advantages of the present invention will emerge from the following description of particular embodiments, which description is given with reference to the accompanying drawings.

DETAILED DESCRIPTION OF THE PREFERRED EMBODIMENTS

Figure 5:
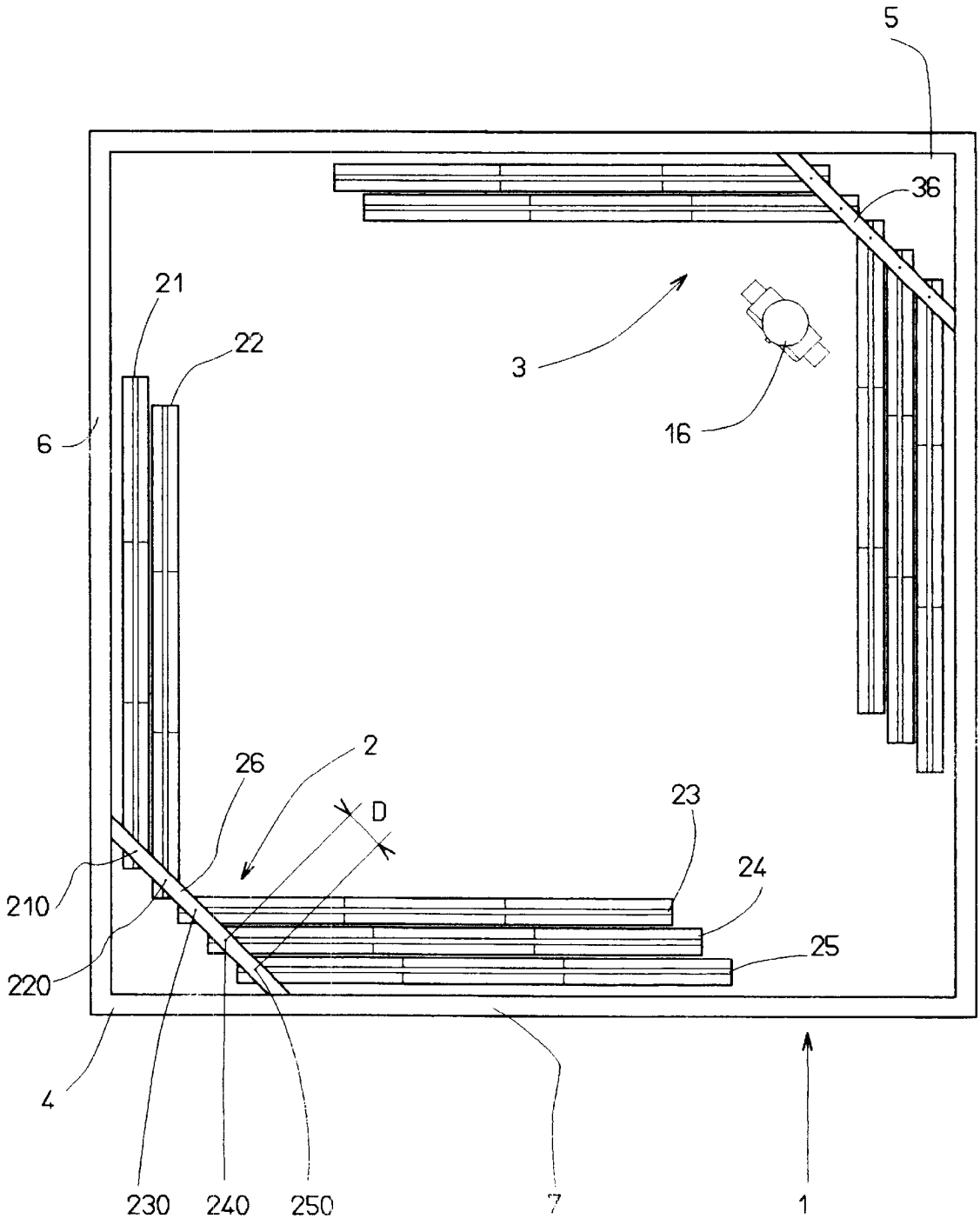
FIG. 5 is a plan view showing one possible disposition of the storage structure in a reserve collection storeroom.

Refer first to FIG. 5, which is a plan view showing a square room 1 in a building, for example a museum reserve collection storeroom, in which one embodiment of a storage structure in accordance with the invention is installed.

In this embodiment, the storage structure includes hinged panels arranged as a first group 2 of panels and a second group 3 of panels.

The first group 2 of panels is installed in a first corner 4 of the room 1, whilst the second group 3 of panels is installed in the opposite corner 5 of the room 1.

Each group of panels, for instance the first group 2 of panels, includes a plurality of panels, for instance the panels 21, 22, 23, 24 and 25, which are generally rectangular, vertically oriented, and hinged about a respective vertical hinge pin 210, 220, 230, 240 and 250 in the vicinity of a first vertical edge to a common fixed structure 26 so that they can pivot between two limit orientations. Accordingly, in FIG. 5, each panel 21–25 can pivot 90° between a first limit position parallel to a first wall 6 of the room 1, and a second limit position parallel to a second wall 7 of the room 1.

Objects, such as works of art, can be fixed to both faces of the panels 21–25, or at least to the faces thereof facing toward an adjacent panel. The respective hinge pins 210–250 of the consecutive panels 21–25 are offset laterally, on the common fixed structure 26, by a distance D chosen to allow the panels to rotate between their limit orientations without the objects that they carry touching each other.

Figure 1:
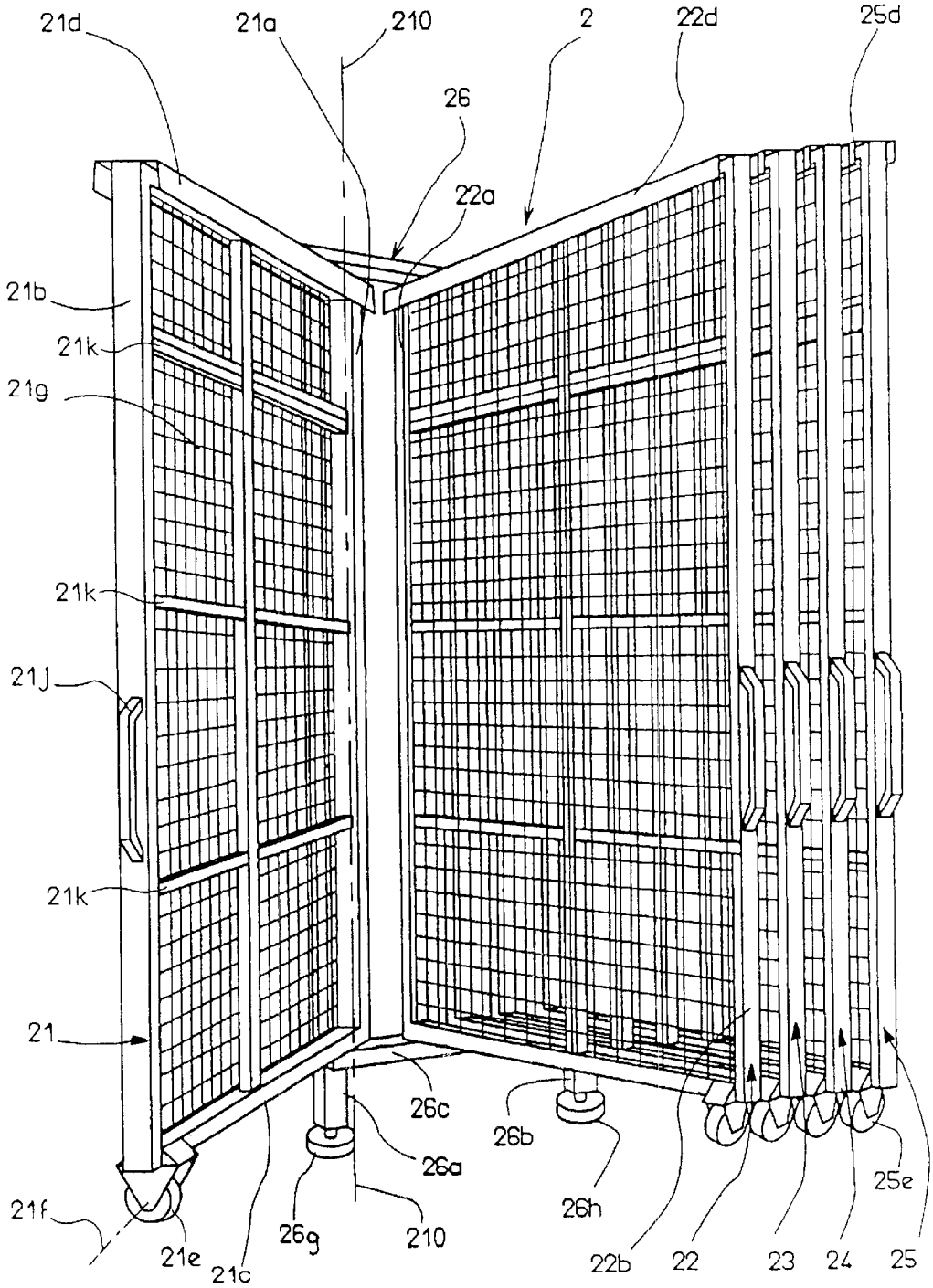
FIG. 1 is a perspective view of one embodiment of a storage structure according to the present invention.

Refer now to FIG. 1, which is a perspective view of a first embodiment of the first group 2 of panels. The common fixed structure 26 to which the panels 21, 22, 23, 24 and 25 are hinged is also shown.

Each panel, for instance the panel 21, has a generally rectangular shape delimited by a first vertical edge 21*a*, a second vertical edge 21*b*, a bottom horizontal edge 21*c* and a top horizontal edge 21*d*. The hinge pin 210 of the panel 21 is in the vicinity of the first vertical edge 21*a*.

Each panel, for instance the panel 21, has on its bottom horizontal edge 21*c*, a support wheel 21*e* at a distance from the hinge pin 210 of the panel 21 and adapted to roll on the floor about a rotation pin 21*f* parallel to the general plane of the panel 21 and to support the panel 21 cantilever-fashion.

In the embodiment shown in FIG. 1, each panel, for instance the panel 21, is made up of a rigid rectangular frame with two uprights flanking the vertical edges 21*a* and 21*b* and two crossmembers flanking the horizontal edges 21*c* and 21*d*. The frame surrounds a grid 21*g* from the meshes of which objects such as works of art can be suspended.

Clearly the frame can instead or additionally surround and retain horizontal shelves 21*k* for supporting objects such as curios, vases or other works of art.

Figure 2:
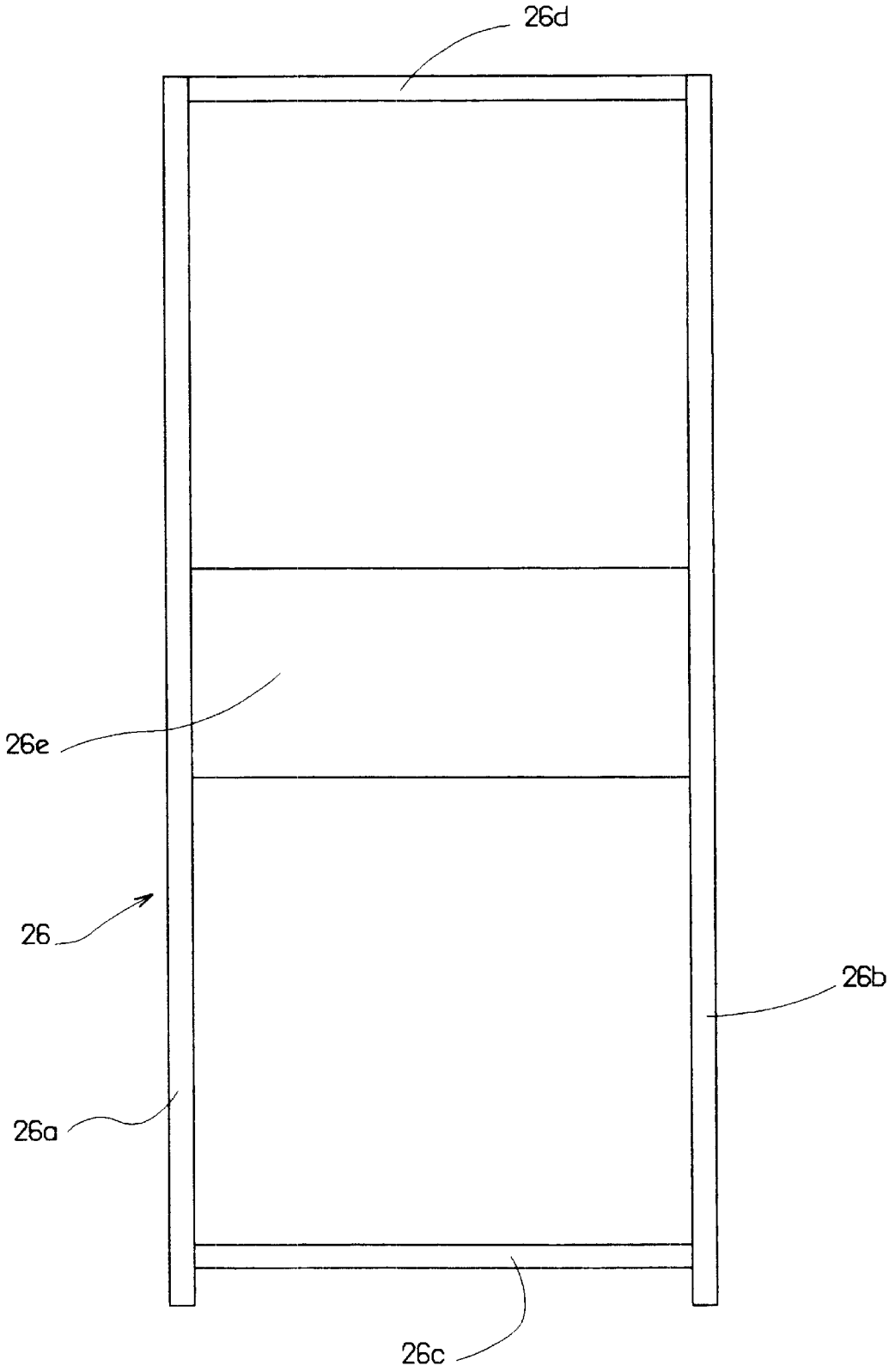
FIG. 2 is a rear view of a common fixed structure to which panels of a group of panels can be hinged according to the invention.

As can be seen more clearly in the rear view of FIG. 2, the common fixed structure 26 includes a generally rectangular frame with two uprights 26*a* and 26*b* connected by two crossmembers 26*c* and 26*d*, with an optional intermediate reinforcing member 26*e* where required. The crossmembers 26*c* and 26*d* receive the hinge means of the panels 21–25.

Figure 3:
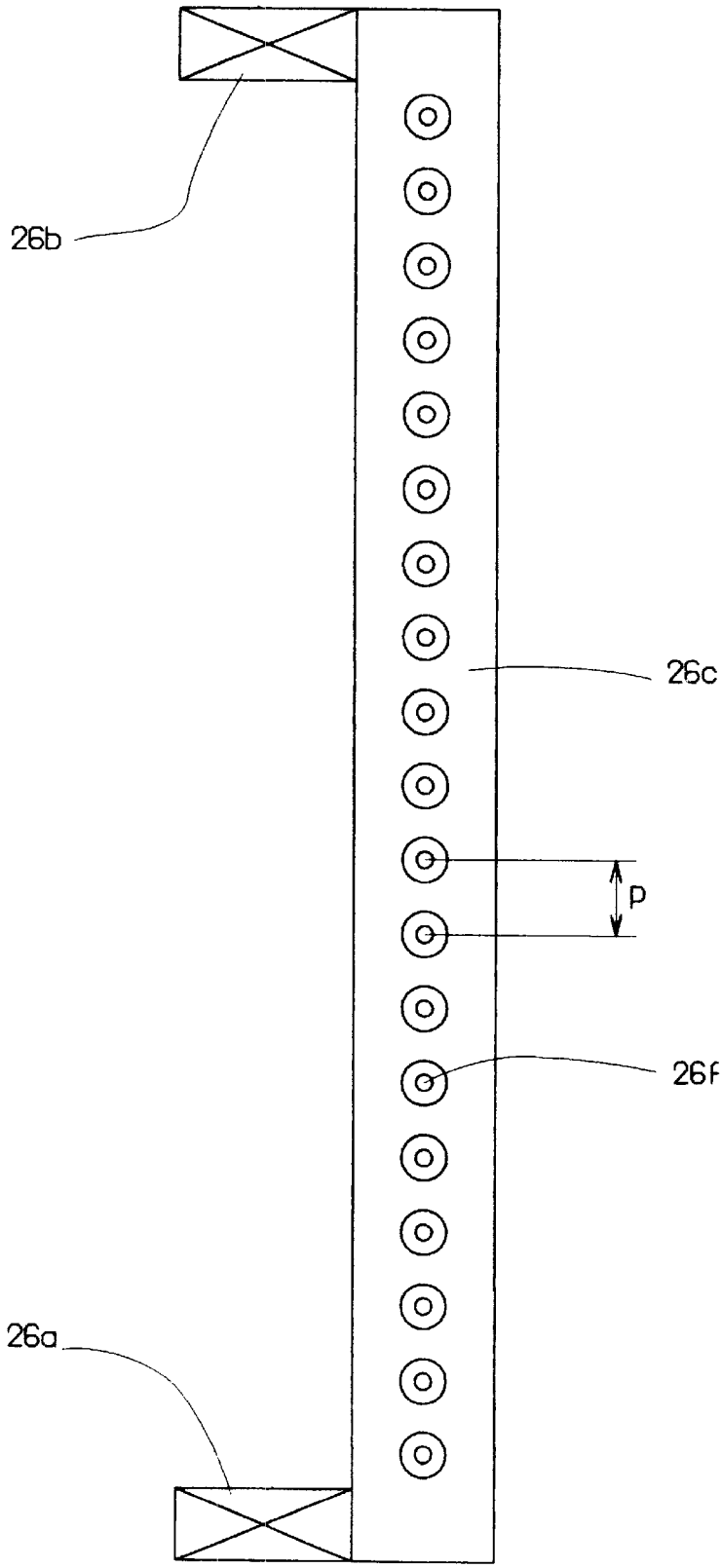
FIG. 3 is a plane view of a bottom crossmember of one advantageous embodiment of the fixed structure shown in FIG. 2.
Figure 4:
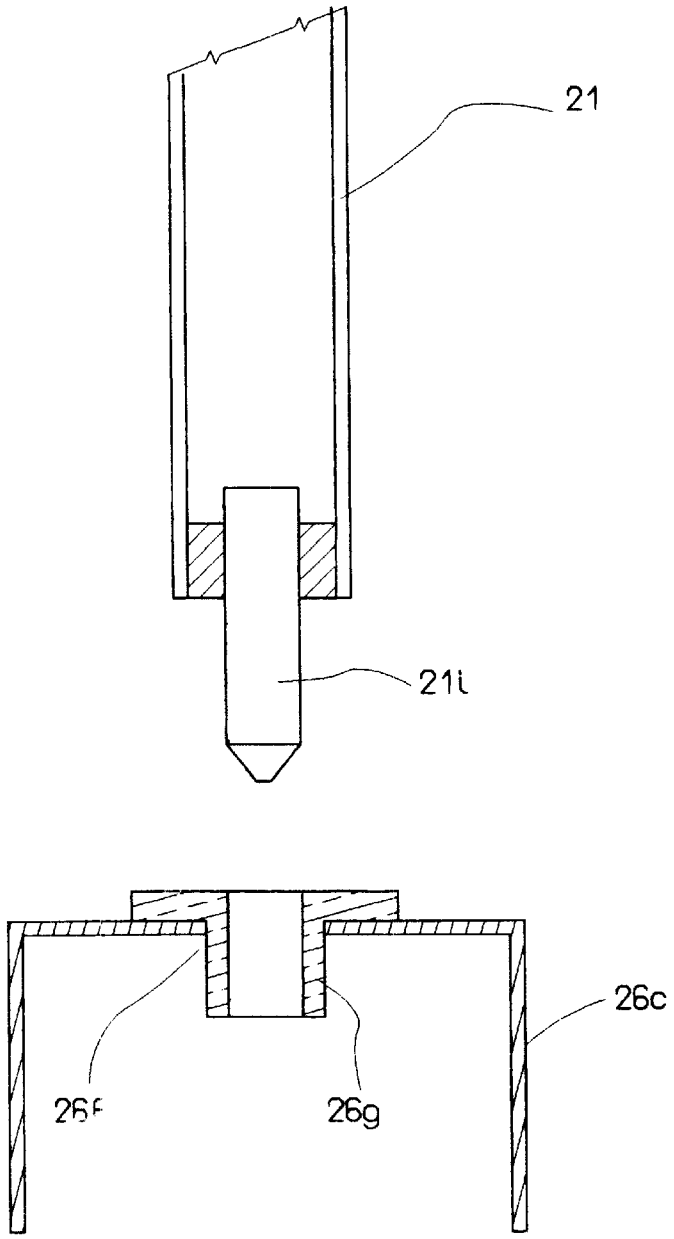
FIG. 4 is a detail view of hinge pivots of the panels of one embodiment of the invention.

FIGS. 3 and 4 show one embodiment of those hinge means. FIG. 3 is a plan view of the bottom crossmember 26*c*, which is slightly offset horizontally relative to the uprights 26*a* and 26*b*, and which incorporates a series of holes, for instance the hole 26*f*. The bottom crossmember 26*c* can be approximately 1 m long, for example, the successive holes being spaced along the length of the bottom crossmember 26*c* at a pitch P of approximately 50 mm. The top crossmember 26*d* can have the same structure.

FIG. 4 shows, in cross section, the bottom crossmember 26*c*, which is a U-section. A flanged bush 26*g* is inserted in the hole 26*f* to constitute a rotation bearing in which a bottom pivot 21*i* of the panel 21 is inserted.

Accordingly, each panel, for instance the panel 21. is hinged to the common fixed structure 26 by a top pivot and by a bottom pivot 21*i*. The top and bottom pivots pass through respective top and bottom holes in the panel 21 and at least one of the pivots is removably attached to the common fixed structure 26. For instance, the bottom pivot 21*i* is fixed to the panel 21, and inserted in the flanged bush 26*g* of the bottom crossmember 26*c*, whilst the top pivot is removably attached to the top crossmember 26*d* of the common fixed structure 26.

Referring again to FIG. 5, for an application to storing paintings, the chosen distance D between the respective hinge pins 240 and 250 of the consecutive panels 24 and 25 is from approximately 20 cm to approximately 30 cm. The distance D can clearly be adjusted by choosing the appropriate holes 26*f* for the passage of the pivots in the crossmembers 26*c* and 26*d* of the common fixed structure 26.

Referring again to FIG. 1, it can be seen that the panels, for instance the panel 21, have in their upper area and at a distance from their hinge pins, for instance the pin 210, abutment means to guarantee a sufficient distance between the consecutive panels 21, 22 and thereby prevent contact between the objects that they carry. For example, the abutment means can consist of a top horizontal crossmember (extending along the top edge 21*d*) that is wider than the rest of the panel 21, adapted to come into lateral bearing engagement against the corresponding top horizontal crossmember of the adjacent panel 22 (extending along the top edge 22*d*).

Equally, each panel, for instance the panel 21, can be provided on the upright extending along its second vertical edge 21*b* with an actuating handle 21*j* to facilitate grasping the panel to pivot it between its limit orientations.

As shown in FIG. 1, the uprights 26*a* and 26*b* of the common fixed structure 26 can advantageously include two screw-jacks 26*g* and 26*h*, so that the common fixed structure 26 rests on the floor on the two screw-jacks 26*g* and 26*h*, which enable its height to be adjusted. This feature makes the structure more stable, and prevents shear loads at floor level, as well as optimizing the smooth movement of the hinged panels.

Figure 7:
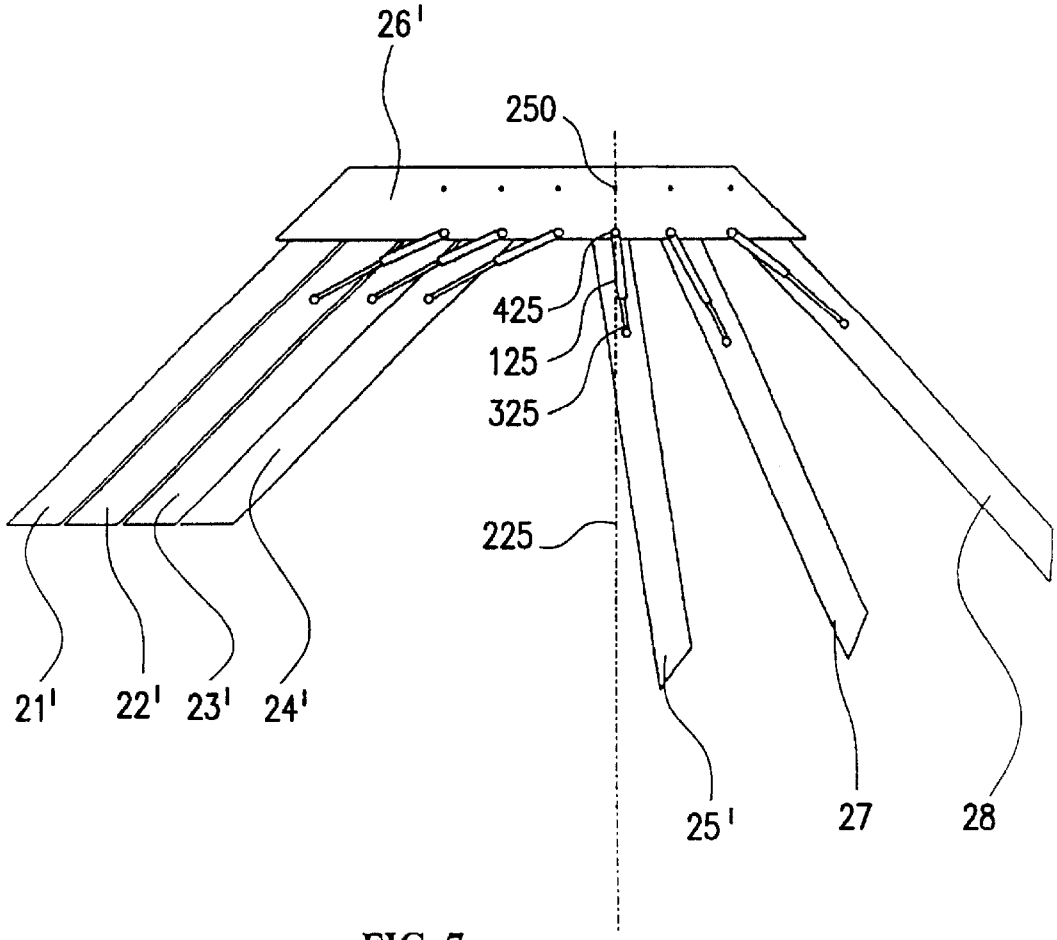
FIG. 7 is a plan view showing one embodiment of the structure according to the invention including rotation drive actuators.

FIG. 7 shows an advantageous embodiment of the invention in which hydraulic actuators, for instance an actuator 125, are adapted to pivot each pivoting panel, for instance the panels 22', 23', 24', 25', 27 and 28, smoothly and at constant speed toward one or the other of its limit orientations from a median orientation (shown by the line 225 for the panel 25', for instance) that is generally perpendicular to the common fixed structure 26'. For instance, a damped compression spring actuator 125 can be provided between the common connecting structure 26' and the top crossmember 25*d* of the panel 25', the actuator 125 being hinged between an intermediate point 325 of the panel 25' and a fixed point 425 of the common fixed structure 26' in front of the hinge pin 250 of the panel 25'. Each actuator enables the panels to be opened and closed very smoothly. On passing the intermediate median position 225, the actuator 125 causes the panel 25' to move at constant speed until it is closed. This disposition guarantees that the works of art attached to the panel 25' are not damaged when it moves.

In a preferred embodiment shown in FIG. 7, which is a variant of the embodiment shown in FIG. 1, a first end panel 21' is fixed and has a fixed bearing and a second end panel 28 has a wheel such as the wheel 25*e* of the embodiment of FIG. 1. The intermediate panels 22' to 27 have possibly no support wheels, and are supported only by their respective hinge pins, on which they pivot, which prevents the vibrations that can occur when support wheels roll on an uneven surface.

In all cases, it is advantageous to position the rolling members, for instance as the wheels 21*e* and 25*e*, near the middle of the bottom crossmembers, for instance the crossmember 21*c*. This reduces general vibrations caused by pivoting of the panels.

Differing from what is shown in FIG. 1, an advantageous embodiment can be envisaged in which the end panels 21' and 28 are solid, constituting continuous covering walls for enclosing all of the intermediate panels in a folded configuration. In this case, the peripheral frames of the consecutive panels are preferably contiguous in the folded configuration, as shown in FIG. 7: for example, the frame of the panel 21' is contiguous with the frame of the panel 22, possibly with combined buffers and seals between the two frames, with the result that the combination of the frames and the end panels 21' and 28 constitutes a dustproof enclosure protecting the interior of the structure containing the objects or works of art.

In this case, the end panels 21' and 28 preferably include at least one wall portion of a dustproof, but possibly air-permeable, material such as Gore-Tex (R) distributed fiber material.

Figure 8:
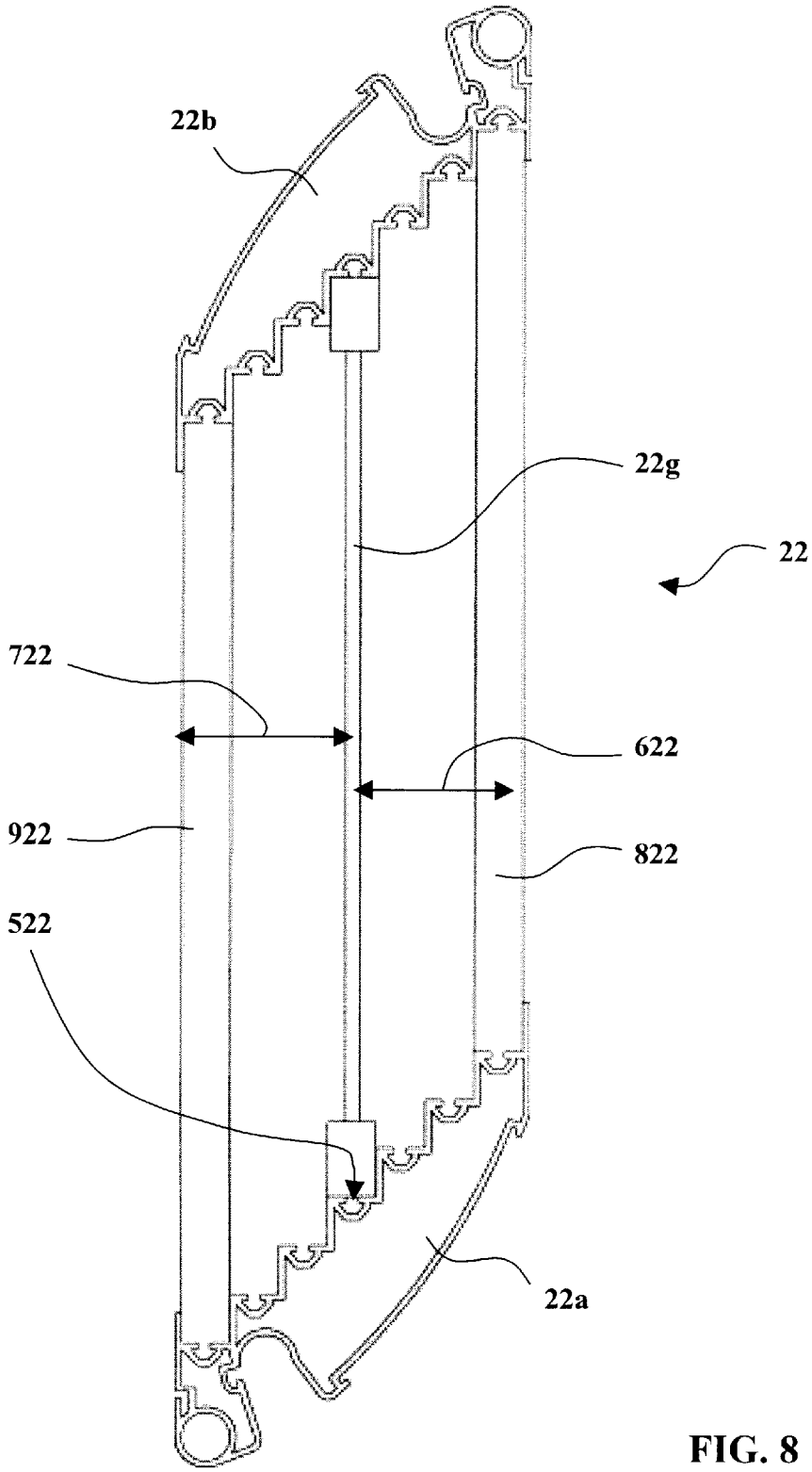
FIG. 8 is a plan view in cross section showing a panel frame structure enabling adjustment of the depth of the space for objects or works of art on either face of a panel.

FIG. 8 shows one particular embodiment of the frame of a panel, for instance the panel 22, enabling adjustment of the thicknesses available for the objects or works of art. In this case, the vertical uprights 22*a* and 22*b* of the frame of the panel 22 have parallel staircase profiles, as shown in the figure, and consist of aluminum extrusions, for example. The staircase sections provide successive housings, for instance the housing 522, each of which can receive the central panel structure 22*g*. The user can therefore choose the position of the central structure 22*g* of the panel to define on respective opposite faces of the central structure 22*g* free spaces 622 and 722 of greater or lesser thickness to receive the objects to be supported.

Alternatively, uprights can be envisaged with an oblique inside face on which slides a vertical U-section constituting a groove that can be adjusted and locked in position to hold the central structure 22*g* of the panel.

In both cases, if the central structure 22*g* is not sufficient to stiffen the panel, top and bottom crossmembers, for instance the crossmembers 822 and 922, can be provided.

Figure 9:
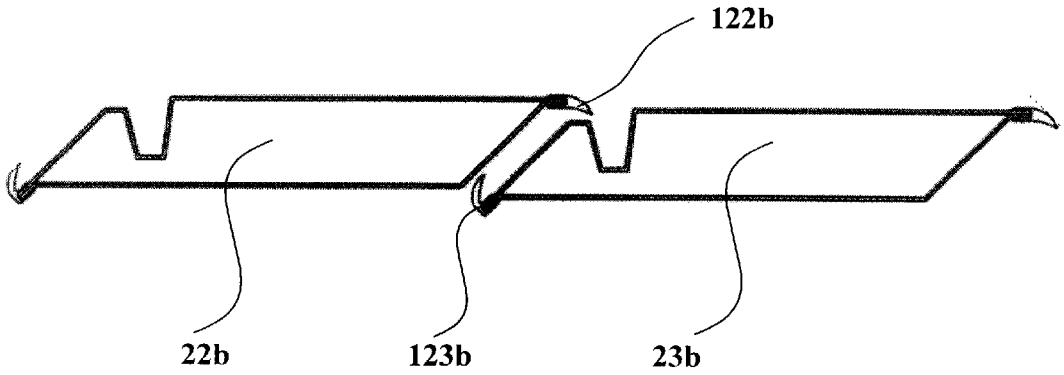
FIG. 9 is a plan view showing a sealing structure between two adjacent panel uprights.

FIG. 9 shows a sealing structure between two adjacent uprights 22*b* and 23*b*: an external lip seal 123*b* on the left-hand edge of the upright 23*b* bears on the outside face of the upright 22 in the closed configuration; an inside re-entrant lip seal 122*b* on the right-hand edge of the upright 22*b* bears against the upright 23*b*.

Figure 10:
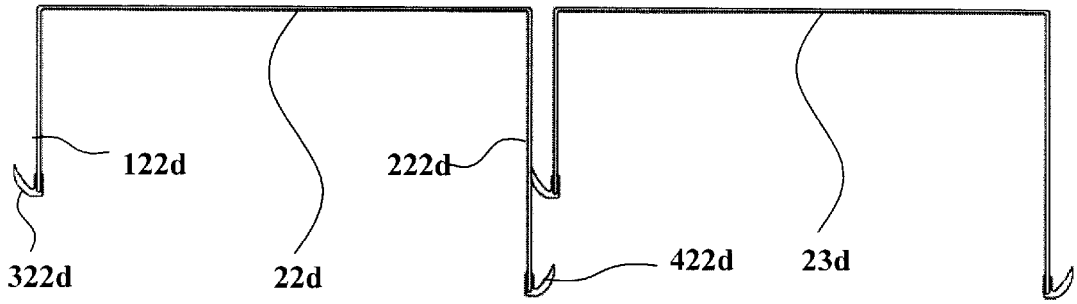
FIG. 10 is a front view in cross section showing a sealing structure between two top crossmembers of adjacent panels.

FIG. 10 shows a possible sealing structure between a crossmember 22*d* and an adjacent crossmember 23*d*. Each crossmember 22*d* (or 23*d*) has two rims 122*d* and 222*d* of different height, each of which carries a re-entrant lip seal 322*d* and 422*d* oriented to bear against the adjacent rim of the next crossmember. The re-entrant lip seals constitute antirunning gutters.

Figure 11:
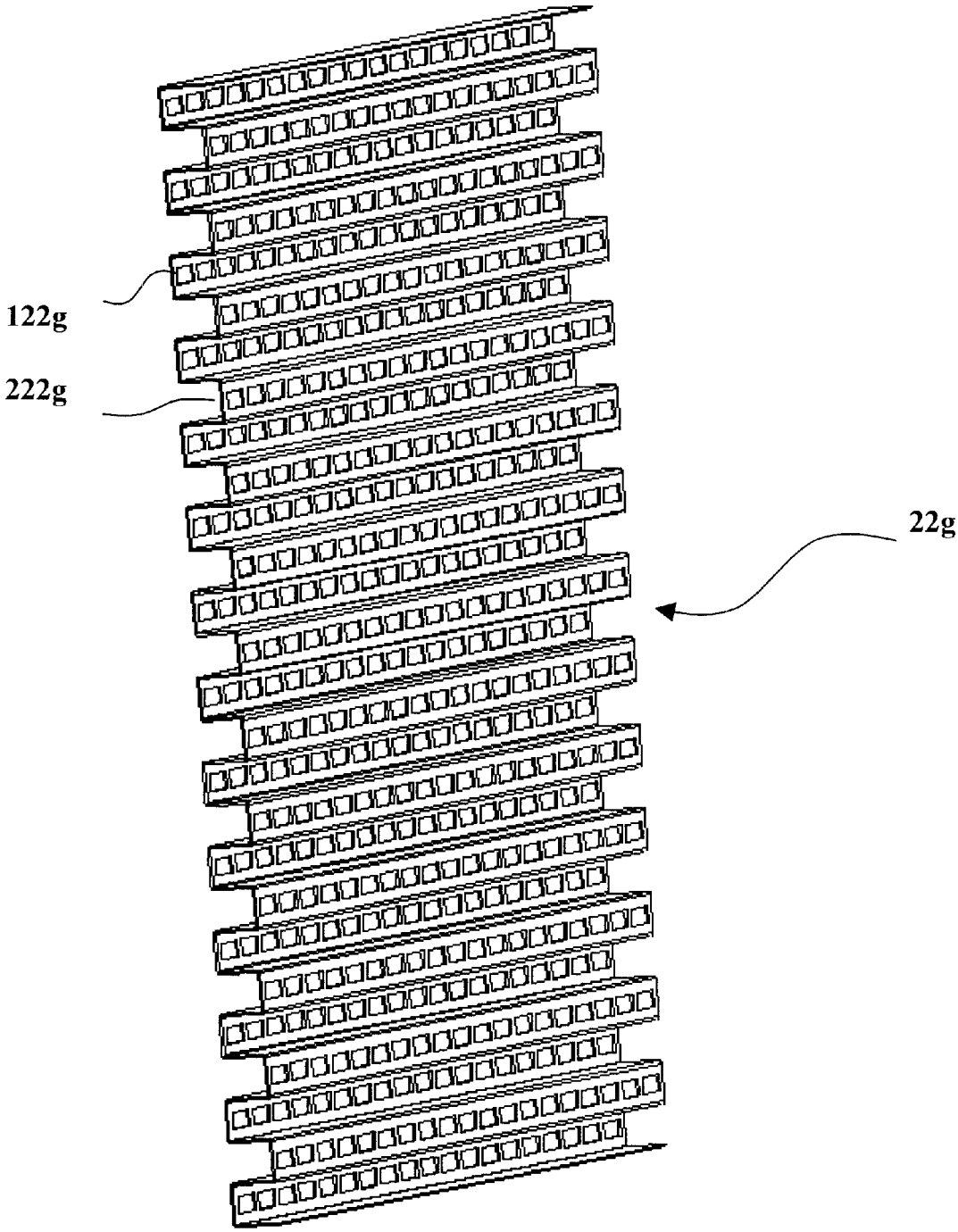
FIG. 11 is a perspective view showing a perforated and corrugated sheet metal panel structure according to the invention.

FIG. 11 is a perspective view of one particularly beneficial shape of the central structure 22*g* of a panel. This structure is formed from perforated and corrugated sheet metal plates with adjacent horizontal crenellations, for instance the recessed crenellation 122*g* and the protruding crenellation 222*g*, shaped to enable objects to be attached to them, the perforations enabling the use of various systems for attaching works of art, which are held more securely. The crenellations can alternatively be vertical. For reasons of overall size, the central structure 22*g* of a panel can be obtained by assembling a plurality of coplanar perforated and bent plates.

Figure 6:
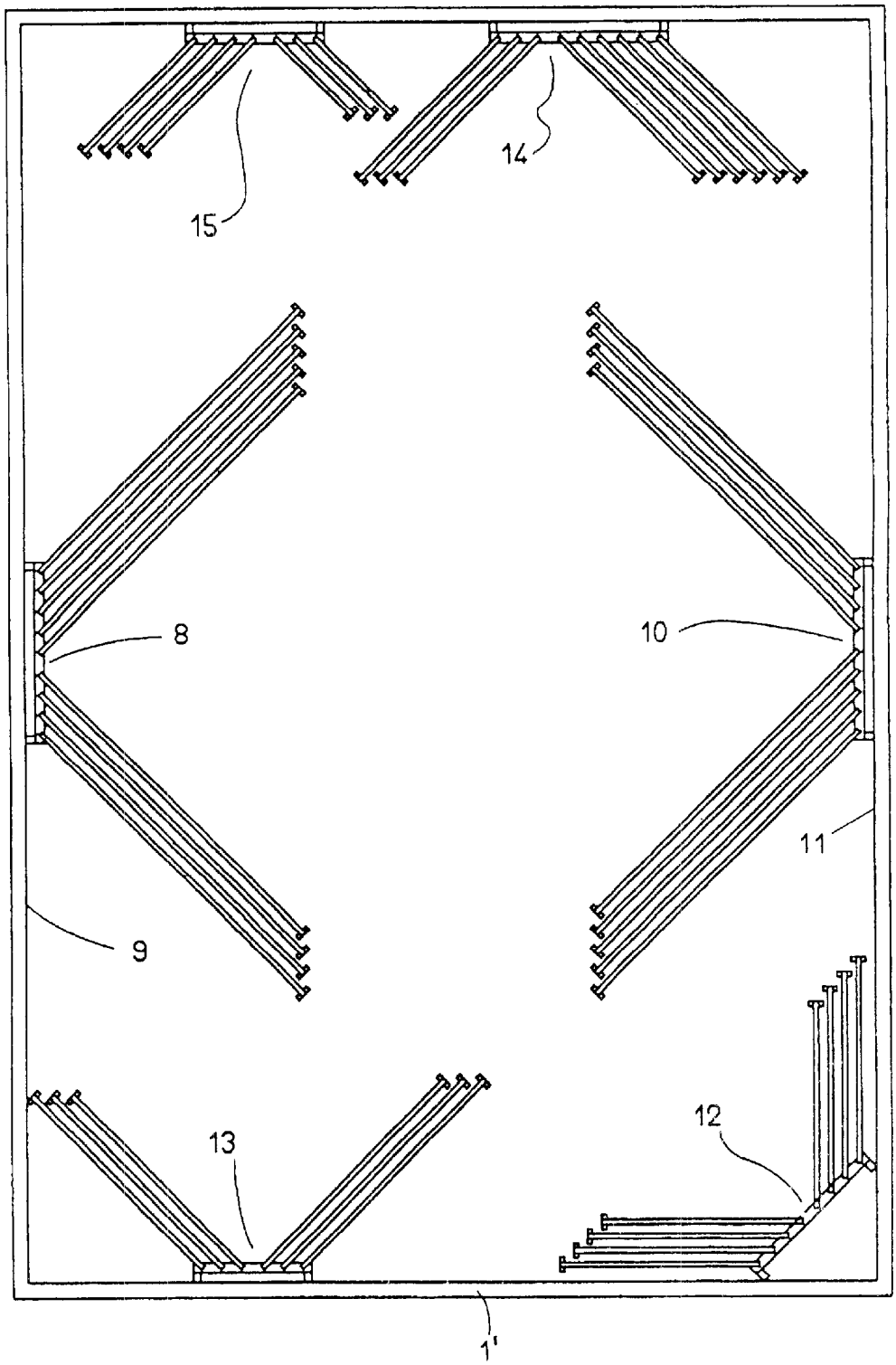
FIG. 6 shows another disposition of a storage structure in accordance with the invention suitable for a different shape of reserve collection storeroom.

As can be seen from FIGS. 5 and 6, a storage structure according to the invention generally includes a plurality of groups of panels, each group of panels being hinged to a respective common fixed structure. For instance, in FIG. 5 there is a first group 2 of panels hinged to a first common connecting structure 26, and a second group 3 of panels hinged to a second common connecting structure 36.

In a storeroom like the room 1, the panels of the groups 2 and 3 of panels are hinged to respective common connecting structures 26 and 36, which are attached to peripheral walls, for instance the walls 6 and 7, of the storeroom 1. With the first arrangement shown in FIG. 5, the common fixed structures 26 and 36 are engaged in opposite corners 4 and 5 of the storeroom 1.

FIG. 6 shows another arrangement of the storage structure in accordance with the invention, suitable for a rectangular storeroom 1'. A group 8 of large panels can then be installed in the middle area of a first longitudinal wall 9 of the room 1', and a second group 10 of large panels in a middle area of the opposite longitudinal wall 11. A third group 12 of small panels is installed in the bottom right-hand corner, and three other groups 13, 14 and 15 of small panels occupy other portions of the peripheral wall, for example.

The panels of each group of panels can advantageously have horizontal lengths such that they pivot freely, between their limit orientations, as shown for the groups 8 and 10 of large panels, for instance, without touching the panels of the other groups of panels in the storeroom 1'. Alternatively, the groups of panels can be moved close together, provided that they are not opened simultaneously.

Clearly, depending on the objects to be stored and on the dimensions of the storeroom, the disposition and the dimensions of the groups of panels can be chosen to optimize the storage area.

Considering FIG. 5, for example, it is clear that a storage structure in accordance with the invention enables an observer 16 to observe objects fixed to panels of the first group 2 of panels at a sufficient distance by standing in the vicinity of the opposite corner 5, and then to observe objects carried by the second group 3 of panels by standing in the vicinity of the opposite corner 4.

The observer 16 can observe objects fixed to both faces of each panel, by pivoting the panels as required between their limit orientations, remaining at the same distance from each panel observed.

With the arrangement shown in FIG. 5, for a five by five meter room, for example, the storage structure in accordance with the invention with hinged panels provides a storage area of approximately 180 square meters, which is much greater than the area available in prior art structures.

Figure 12:
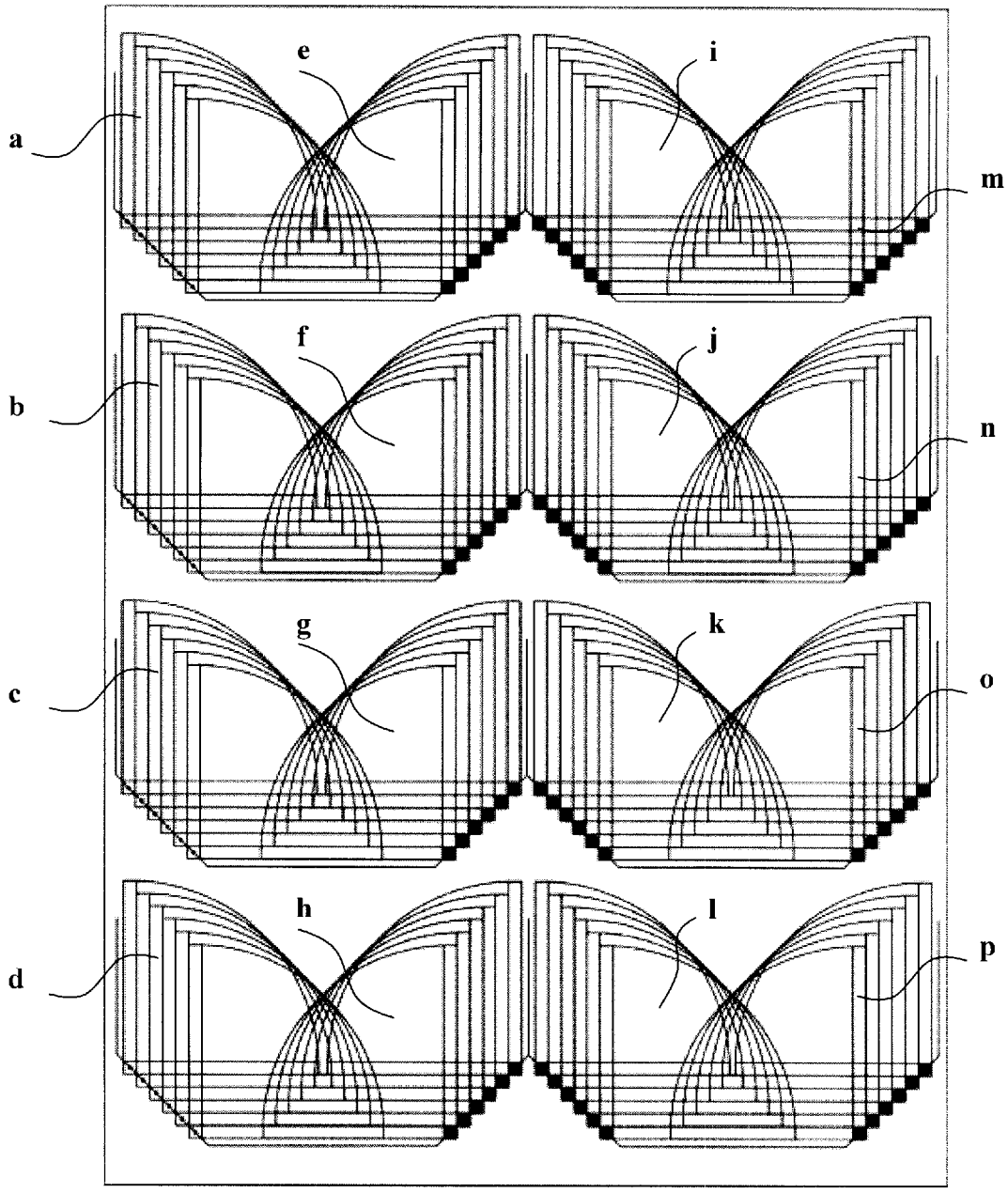
FIG. 12 shows another disposition of the storage structure in a reserve collection storeroom.

The arrangement shown in FIG. 12 further increases the storage area available, on condition that it is acceptable not to open the panels simultaneously. In a rectangular room, sixteen groups of panels can thus be disposed and referenced by the letters a, b, c, d, e, f, g, h, i, j, k, l, m, n, o and p. The folded positions are along the length of the room.

The present invention is not limited to the embodiments that have just been explicitly described but includes various generalizations and variants thereof within the scope of the following claims.

What is claimed is:

1. A storage structure including hinged, generally rectangular panels adapted to receive and support objects, wherein:

said panels are organized into at least one first group of generally rectangular panels, oriented vertically, and which are each hinged directly about a respective hinge pin, in the vicinity of a first vertical edge, to a common connecting structure to pivot approximately 90° between two limit orientations;

respective hinge pins of consecutive hinged panels are offset laterally on said common connecting structure by a distance chosen to allow said hinged panels to rotate between said limit orientations:

at least some panels include, on their bottom horizontal edge, a support means at a distance from said hinge pin of said panel and adapted to bear on a floor and thereby stabilize the structure as a whole on said floor; and wherein the storage structure includes end panels which are solid, constituting covering walls for enclosing all intermediate panels in a folded configuration.

2. The storage structure claimed in claim 1 including panels consisting of at least one rigid rectangular frame, each surrounding and retaining a grid.

3. The storage structure claimed in claim 2 wherein said panel frames include vertical uprights which define successive or movable housings adapted to receive a central panel structure made up of said grid, so that a user can select the position of said central panel structure to define a free space of greater or lesser thickness on respective opposite faces of said panel to receive said objects.

4. The storage structure claimed in claim 1 including panels consisting of a rectangular frame surrounding and retaining horizontal shelves.

5. The storage structure claimed in claim 1 wherein said panels include in their upper area, and at a distance from their hinge pins, abutment means for guaranteeing a sufficient spacing between consecutive panels and thereby preventing contact between objects that they carry.

6. The storage structure claimed in claim 1 including solid end panels and wherein, in a folded configuration, peripheral frames of consecutive panels are contiguous, optionally with combined buffers and seals between them, and constitute a dustproof enclosure.

7. The storage structure claimed in claim 6 wherein said end panels include at least one wall portion made of a dustproof but air-permeable material.

8. The storage structure claimed in claim 1 including panels consisting of at least one rigid rectangular frame, each surrounding and retaining parallel laths.

9. The storage structure claimed in claim 8 wherein said panel frames include vertical uprights which define successive or movable housings adapted to receive a central panel structure made up of said laths, so that a user can select the position of said central panel structure to define a free space of greater or lesser thickness on respective opposite faces of said panel to receive said objects.

10. The storage structure claimed in claim 1 including panels consisting of at least one rigid rectangular frame, each surrounding and retaining at least one perforated and corrugated sheet metal plate.

11. The storage structure claimed in claim 10 wherein said panel frames include vertical uprights which define successive or movable housings adapted to receive a central panel structure made up of said perforated plates, so that a user can select the position of said central panel structure to define a free space of greater or lesser thickness on respective opposite faces of said panel to receive said objects.

12. The storage structure claimed in claim 1 wherein said panels include in their peripheral area, and at a distance from their hinge pins, abutment means for guaranteeing a sufficient spacing between consecutive panels and thereby preventing contact between objects that they carry.

13. A storage structure including hinged, generally rectangular panels adapted to receive and support objects, wherein:

said panels are organized into at least one first group of generally rectangular panels, oriented vertically, and which are each hinged directly about a respective hinge pin, in the vicinity of a first vertical edge, to a common connecting structure to pivot approximately 90° between two limit orientations;

respective hinge pins of consecutive hinged panels are offset laterally on said common connecting structure by a distance chosen to allow said hinged panels to rotate between said limit orientations, at least some panels include, on their bottom horizontal edge, a support means at a distance from said hinge pin of said panel and adapted to bear on a floor and thereby stabilize the structure as a whole on said floor; and further including damped actuators adapted to pivot each hinged panel smoothly towards either of its limit orientations from a median orientation, which is generally perpendicular to said common connecting structure.

14. The storage structure claimed in claim 13 wherein said common connecting structure includes a generally rectangular frame with two uprights connected by two crossmembers, said crossmembers receive hinge means of said panels, and said common connecting structure rests on said floor on height adjusting means.

* * * * *